US012662997B2

(12) United States Patent
Love et al.

(10) Patent No.: US 12,662,997 B2
(45) Date of Patent: Jun. 23, 2026

(54) ACTIVE BALANCING OF MULTIPLE INTERLEAVED PIEZO PUMPS

(71) Applicant: SAFRAN LANDING SYSTEMS UK LTD., Gloucester (GB)

(72) Inventors: Tom Love, Gloucester (GB); Wayne Capener, Gloucester (GB); Tom Feehally, Bath (GB); Peter Wilson, Bath (GB); Nathan Sell, Bath (GB)

(73) Assignee: SAFRAN LANDING SYSTEMS UK LTD., Gloucester (GB)

( * ) Notice: Subject to any disclaimer, the term of this patent is extended or adjusted under 35 U.S.C. 154(b) by 0 days.

(21) Appl. No.: 18/846,952

(22) PCT Filed: Mar. 8, 2023

(86) PCT No.: PCT/EP2023/055923
§ 371 (c)(1),
(2) Date: Sep. 13, 2024

(87) PCT Pub. No.: WO2023/174776
PCT Pub. Date: Sep. 21, 2023

(65) Prior Publication Data

US 2025/0101974 A1 Mar. 27, 2025

(30) Foreign Application Priority Data

Mar. 15, 2022 (GB) ..... 22162042

(51) Int. Cl.
*F04B 43/04* (2006.01)
*F04B 17/00* (2006.01)
(Continued)

(52) U.S. Cl.
CPC ..... *F04B 43/046* (2013.01); *F04B 17/003* (2013.01); *F04B 23/04* (2013.01);
(Continued)

(58) Field of Classification Search
CPC ..... F04B 43/046; F04B 17/003; F04B 49/06; F04B 2203/0402; F04B 45/047;
(Continued)

(56) References Cited

U.S. PATENT DOCUMENTS 4,939,405 A * 7/1990 Okuyama ..... F04B 43/046 310/317
7,317,274 B2 * 1/2008 Vogeley ..... H10N 30/802 310/317
(Continued)

FOREIGN PATENT DOCUMENTS

| | | | |
|---|---|---|---|
| CN | 112392699 | A | 2/2021 |
| EP | 3120023 | A1 | 1/2017 |
| WO | 2015/131033 | A1 | 9/2015 |

OTHER PUBLICATIONS

Decision to grant received for European Application No. 22162042, mailed on Jul. 11, 2024, 2 pages.
(Continued)

*Primary Examiner* — Peter J Bertheaud
(74) *Attorney, Agent, or Firm* — WOMBLE BOND DICKINSON (US) LLP

(57) ABSTRACT

A drive circuit for a plurality of piezo-actuated hydraulic pumps for an aircraft, and a hydraulic pump system implementing the same. The drive circuit includes a voltage boost stage that receives a DC input supply voltage and delivers an increased DC output voltage to a high voltage, HV, link point; a plurality of inverter stages coupled in parallel at the HV link point that receive DC voltage from the HV link point and generate an oscillating output voltage for driving a respective piezo-actuated pump; and a control system that controls the output voltage and phase of the inverter stages to drive the plurality of piezo-actuated pumps out of phase. The control system measures the power consumption of each piezo-actuated pump and regulates the output voltage
(Continued)

of at least one of the inverter stages to balance the power consumption of each piezo-actuated pump.

11 Claims, 7 Drawing Sheets

(51) Int. Cl.

| | |
|---|---|
| ***F04B 23/04*** | (2006.01) |
| ***F04B 23/06*** | (2006.01) |
| ***F04B 41/06*** | (2006.01) |
| ***F04B 43/02*** | (2006.01) |
| ***F04B 45/047*** | (2006.01) |
| ***F04B 49/06*** | (2006.01) |

(52) U.S. Cl.
CPC ..... *F04B 23/06* (2013.01); *F04B 41/06* (2013.01); *F04B 43/026* (2013.01); *F04B 43/043* (2013.01); *F04B 45/047* (2013.01); *F04B 49/06* (2013.01); *F04B 49/065* (2013.01); *F04B 43/04* (2013.01); *F04B 2203/0401* (2013.01); *F04B 2203/0402* (2013.01); *F04B 2203/0408* (2013.01)

(58) Field of Classification Search
CPC ..... F04B 2203/0401; F04B 23/06; F04B 49/065; F04B 43/026; F04B 23/04; F04B 41/06; F04B 43/043; F04B 2203/0408
See application file for complete search history.

(56) References Cited

U.S. PATENT DOCUMENTS

| | | | | |
|---|---|---|---|---|
| 7,564,164 | B2 * | 7/2009 | Yamamoto | F04B 17/003 310/317 |
| 7,969,064 | B2 * | 6/2011 | Vogeley | H10N 30/802 310/317 |
| 10,221,843 | B2 * | 3/2019 | Locke | F04B 49/065 |
| 11,639,714 | B2 * | 5/2023 | Tanaka | F04B 23/06 417/410.1 |
| 11,939,970 | B2 * | 3/2024 | Okaguchi | F04B 43/046 |
| 2004/0095039 | A1 | 5/2004 | Chou et al. | |
| 2007/0242427 | A1 | 10/2007 | Yamamoto et al. | |
| 2011/0190670 | A1 | 8/2011 | Jaeb et al. | |
| 2020/0318631 | A1 | 10/2020 | Okaguchi | |

OTHER PUBLICATIONS

European Search Report and Search Opinion received for European Application No. 22162042.0, mailed on Sep. 12, 2022, 5 pages.
Intention to grant received for European Application No. 22162042.0, mailed on Apr. 26, 2024, 6 pages.
International Search Report and Written Opinion received for PCT Patent Application No. PCT/EP2023/055923, mailed on Apr. 12, 2023, 11 pages.

* cited by examiner

ACTIVE BALANCING OF MULTIPLE INTERLEAVED PIEZO PUMPS

BACKGROUND OF THE INVENTION

This application relates to an improved design for a piezo-electric fluid pump system and a pump drive circuit for driving the pump system.

Other than small personal aircraft, present day aircraft have a number of hydraulically operated systems, such as wing flap actuators and landing gear actuators. To date, a central hydraulic pump is provided to provide a supply of pressurised hydraulic fluid to each system. Each system may have its own dedicated pump, or multiple pumps, or alternatively all the hydraulic systems may be serviced by the same pump(s). This centralised arrangement has a number of disadvantages, such as increased number of pipes and valves, which can have an increased cost penalty due to the lengths and pressures on an aircraft.

To mitigate against the disadvantages of a centralised hydraulic system for aircraft it is possible to make use of electro-hydraulic actuators (EHA), in which each actuator has its own associated, often integrated, electrically driven hydraulic pump. Distributing power around the aircraft to each of the actuators electrically rather than hydraulically brings with it a reduction in weight and an increase in system controllability.

A conventional EHA includes a hydraulic piston, gear or vane pump driven by a separate electric motor and associated motor drive electronics. Replacing these separate components with a piezoelectric pump (piezo pump) could bring about a further reduction in weight and the number of components prone to wear. However, while piezo pumps have existed for several years within microfluidics, there needs to be a substantial improvement in the pressure and flow capability to compete with traditional EHA. Increasing the pressure and flow capability of a piezo pump system requires a number of challenges to be addressed.

SUMMARY OF THE INVENTION

According to a first aspect of the invention there is provided a drive circuit for a plurality of piezo-actuated hydraulic pumps for an aircraft. The drive circuit comprises: a voltage boost stage configured to receive a DC input supply voltage and deliver an increased DC output voltage to a high voltage, HV, link point; a plurality of inverter stages coupled in parallel at the HV link point, wherein each inverter stage is arranged to receive DC voltage from the HV link point and generate an oscillating output voltage for driving a respective piezo-actuated pump; and a control system configured to control the output voltage and phase of the inverter stages to drive the plurality of piezo-actuated pumps out of phase. The control system is further configured to measure the power consumption of each piezo-actuated pump and to regulate the output voltage of at least one of the inverter stages to balance the power consumption of each piezo-actuated pump.

With this arrangement, a single boost converter delivers real power to a number of paralleled inverter stages, which each supply the full reactive power for the piezo pumps. Operating multiple piezo pumps out of phase allows their reactive component to be utilised to produce a more continual load power. This can result in a reduced peak power demand at the coupled (HV link) point, allowing passive circuit components to be reduced in size. Similarly, the boost stage can be rated for mean power, rather than peak power, enabling increased power density. Together, these changes reduce the overall mass and volume of the electronics, increase the power density of the driver and increase drive efficiency. Sharing power electronics can also have system benefits including reduced cost, overall mass and volume (due to packaging), as well as improved reliability.

Additionally, balancing the power consumption of the piezo pumps using the control system can enable an optimal power electric design to be realised. The balancing provides a way of practically sharing power electronics for two or more different pumps by matching the loads where possible to reduce the peak demands and so reduce the size of components within the power electronics. The control system can be implemented with a closed loop controller used to regulate the power to each stack by varying the demand voltage.

The DC input supply voltage to the voltage boost stage may be provided by an aircraft HVDC bus. The boost stage and the paralleled inverter stages may be decoupled at the HV link, allowing each stage to be designed and controlled independently.

Optionally, each inverter stage comprises a pulse width modulation, PWM, controlled half-bridge inverter and the control system is a switch control system for PWM generation. A demand reference signal may provide the waveform and amplitude, which the half-bridge tracks.

Optionally, the boost stage comprises an asynchronous boost converter. The half-bridge and boost converters can be based on SiC MOSFETs. High frequency, high efficiency, switching allows the size of passive components in the power circuit to be reduced and so their designs benefit from the high transition rates of these semiconductors.

Optionally, the drive circuit also includes a number of LC power filters. Each inverter stage may comprise at least one of: a link filter comprising an LC filter connected between a respective half-bridge inverter and the HV link point; and an output filter comprising an LC filter connected between the respective half-bridge inverter and a respective piezo pump. The boost stage may further comprise an input filter comprising an LC filter coupled at an input of the asynchronous boost converter.

Optionally, the control system is configured to control the phase of the inverter stages to separate the plurality of piezo-actuated pumps in phase according to the relationship 360°/N, where N is the number of pumps.

Optionally, the drive circuit comprises two paralleled inverter stages for driving two piezo-actuated hydraulic pumps 180 degrees out of phase. Alternatively, the drive circuit may comprise three paralleled inverter stages for driving three piezo-actuated hydraulic pumps 120 degrees out of phase. With three paralleled inverter stages, the fundamental frequency and 2nd harmonic frequency can be cancelled, allowing further reduction in power filter size.

Optionally, the control system is configured to detect a failure of one or more piezo-actuated pumps of the plurality of piezo-actuated pumps. The control system may be further configured to automatically adjust the phase and/or voltage output of one or more the inverter stages in response to detecting a failure of one or more piezo-actuated pumps. This can enable the system to compensate for a failure in any of the pumps, so that the remaining (operational) pumps can continue to provide hydraulic fluid as efficiently as possible.

Optionally, the drive circuit comprises a plurality of pressure sensors arranged to measure hydraulic pressure in each of the plurality of piezo-actuated pumps. The control system may be configured to determine a hydraulic phase of the piezo-actuated pumps based on the pressure measurements and to adjust the phase of one or more of the inverter stages based on the determined hydraulic phase. The hydraulic phase refers to the phase of the output hydraulic pressure cycle for each piezo pump and may be derived by detecting peak pressures in the pumping cycle. With this arrangement, the phase of the inverter stages can be adjusted to achieve the desired phase separation for the piezo pumps, correcting for any discrepancies between electrical phase (i.e., the phase of the inverter stages) and the actual hydraulic phase. Where the pumps drive the same hydraulic load, this can reduce peak flows whilst maintaining mean flow, thereby reducing losses.

Because the electrical load is affected by the operation of the valves, the control system is advantageously configured to adjust the phase of the one or more inverter stages based on the determined hydraulic phase prior to regulating the output voltage of the at least one inverter stages to balance the power consumption of each piezo-actuated pump.

In a second aspect, the invention provides a hydraulic pump system including the drive circuit and the plurality of piezo-actuated hydraulic pumps. This pump system can provide significantly increased pump output for piezo-actuated pumps (greater than 0.5 L/min free flow and 30 bar deadhead pressure) whilst also reducing the size In a third aspect, the invention provides an actuator system for an aircraft. The actuator system includes the hydraulic pump system and a hydraulic actuator arranged to receive hydraulic power from the hydraulic pump system. In a fourth aspect, the invention provides a further actuator system for an aircraft. The actuator system comprises a plurality of hydraulic actuators and the hydraulic pump system, wherein: a first actuator of the plurality of actuators is arranged to receive hydraulic power from a first piezo-actuated hydraulic pump of the plurality of piezo-actuated hydraulic pumps; and a second actuator of the plurality of actuators is arranged to receive hydraulic power from a second piezo-actuated hydraulic pump of the plurality of piezo-actuated hydraulic pumps. The hydraulic actuator may be an actuator for an aircraft landing gear. In the case where the pumps are used to power the same hydraulic load, running multiple pumps out of phase can result in more continuous flow and therefore reduce the losses. This can create a more consistent pressure for the piezo stack to overcome and, due to the coupling between electrical and mechanical domains, a more consistent hydraulic load results in a more consistent and balanced electrical load. Having more than one pump also provides a degree a fault tolerance, since the one or more pumps can remain operational if any of the other pumps fail.

BRIEF DESCRIPTION OF THE DRAWINGS

Embodiments of the invention will now be described with reference to the accompanying drawings, in which.

DETAILED DESCRIPTION OF EMBODIMENTS

The basic principle of a piezo pump is that a stack of piezoelectric elements is driven by an alternating voltage, which causes the stack to alternatively expand and contract in a reciprocating motion. The expansion and contraction of the stack in turn causes the volume of a fluid pumping chamber to alternatively increase and decrease, thus causing a volume of fluid to be pumped in and out of the chamber. The flow of fluid in and out of the chamber can be controlled by one-way valves; together, the stack and valves create the required flow.

Figure 1:
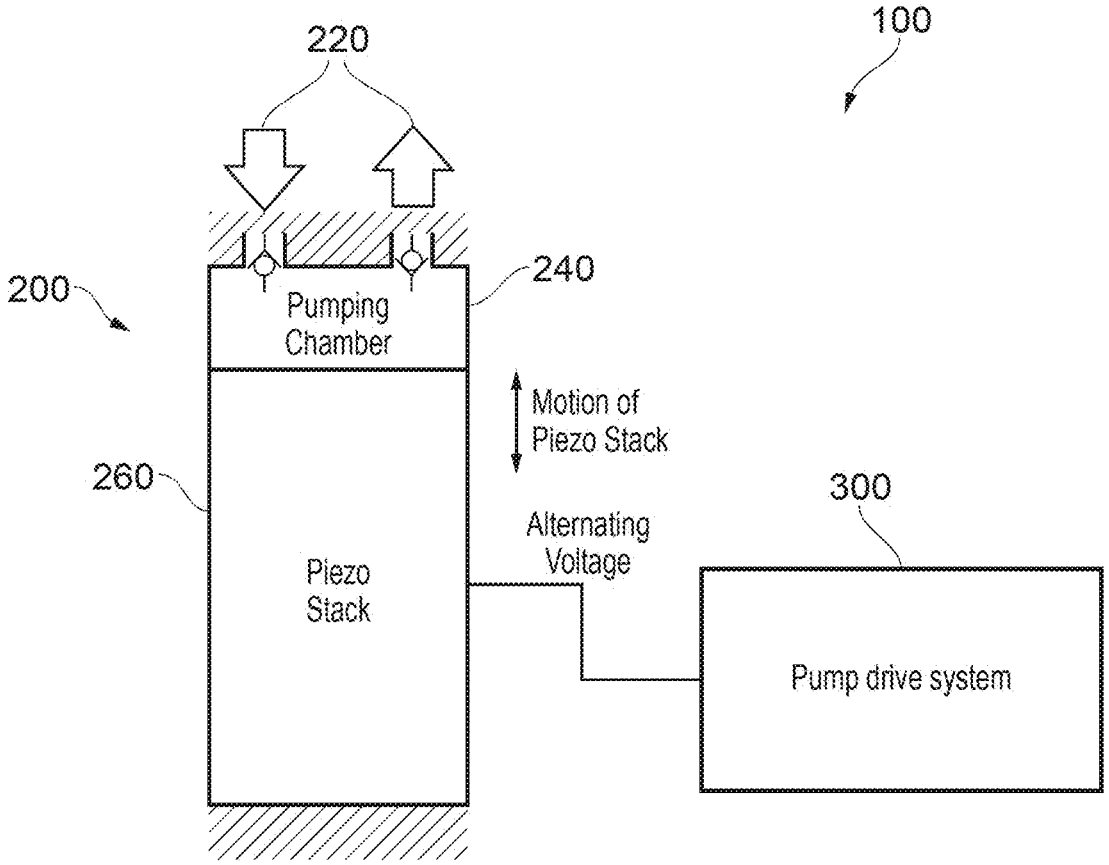
FIG. 1 is a diagram of a pump system including a single piezo-actuated hydraulic pump.

An example of a piezo pump system 100 is shown in FIG. 1. The pump system 100 can be used to provide hydraulic power for any hydraulically operated system, such as an actuator for an aircraft landing gear system.

The piezo pump system 100 comprises a piezo pump 200 and a pump drive system 300. The piezo pump 200 comprises a housing having a pumping chamber 240 and a pair of non-return valves 220 spaced from one another within the housing with the pumping chamber 240 between them. One non-return valve of the pair is arranged to permit the flow of hydraulic fluid into the pumping chamber 240 and the other non-return valve of the pair is arranged to permit the flow of hydraulic fluid out of the pumping chamber, as shown by the arrows. A piezoelectric element 260, preferably comprising a piezoelectric stack (piezo stack) as shown, is arranged to change the volume of the pumping chamber 240 (for instance by expanding and contracting within the pumping chamber 240) to draw fluid into the chamber 240 from the inlet valve when the chamber volume increases and expel fluid from the chamber out of the outlet valve when the chamber volume decreases. However, it will be appreciated that the piezoelectric pump 200 of embodiments of the invention can take any suitable form and, in practice, may be more complicated and comprise additional components.

Figure 2:
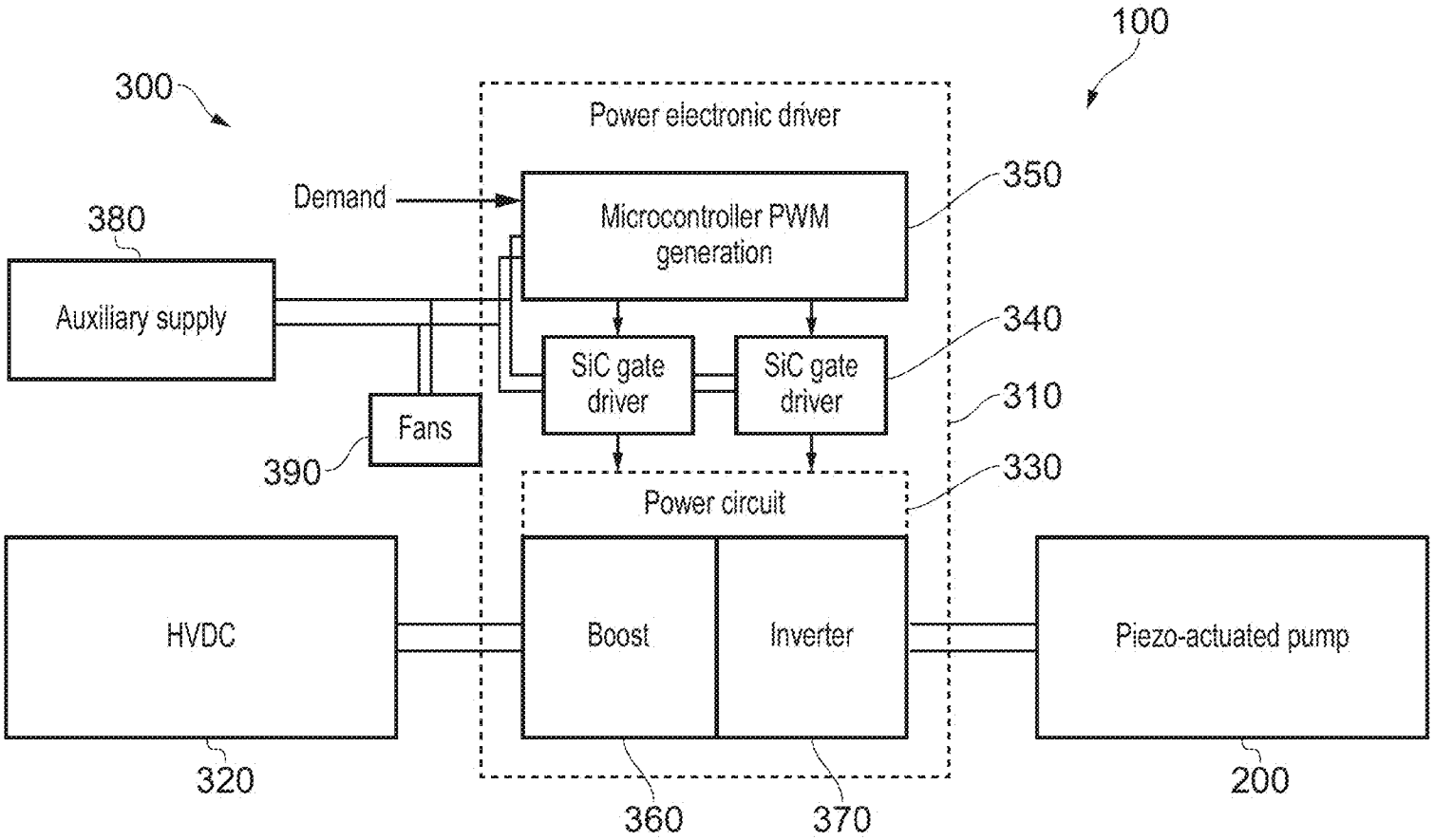
FIG. 2 is a diagram of a pump drive system for driving a single-pump system.
Figure 3:
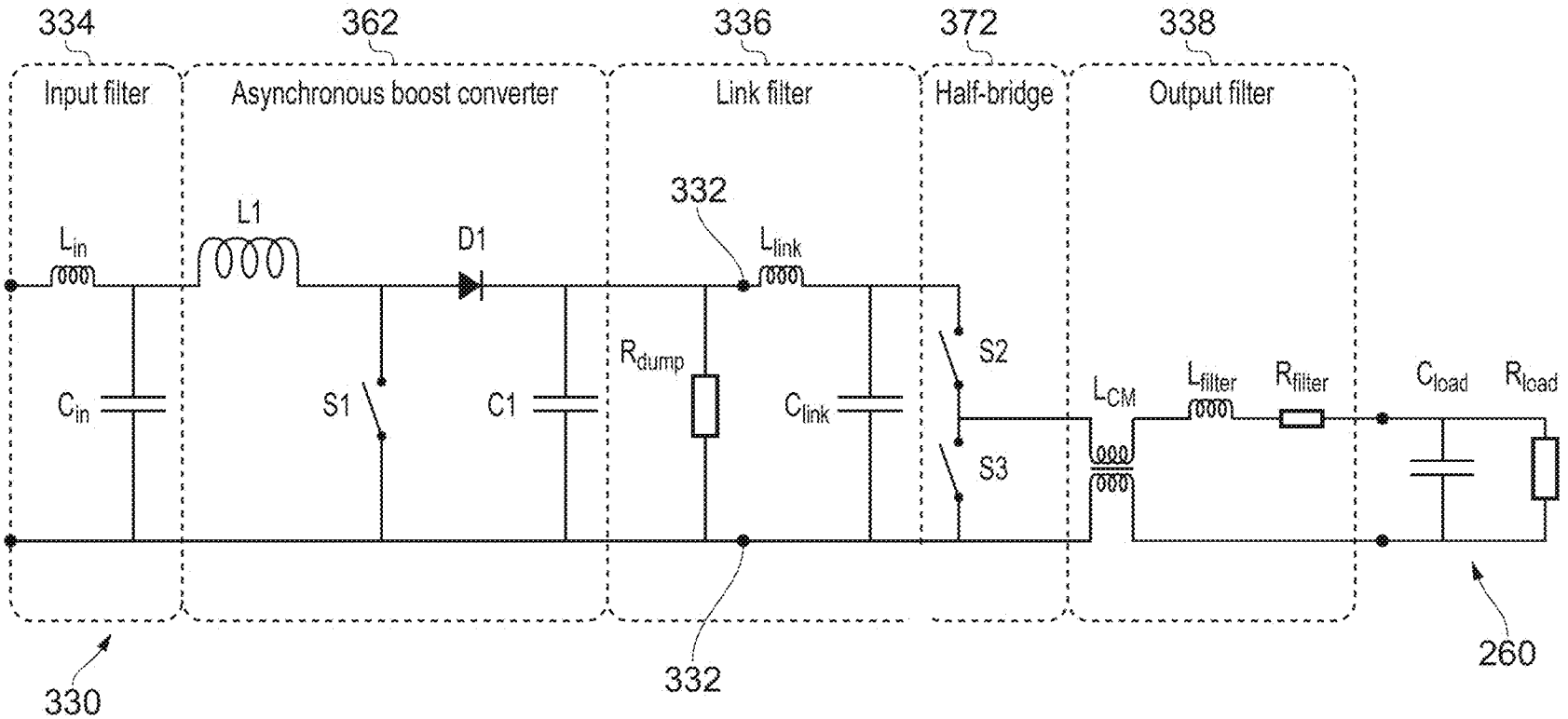
FIG. 3 is a diagram of a power circuit for a pump drive system.

The pump drive system 300 delivers the periodic (e.g., sinusoidal) voltage output for driving the reciprocating motion of the piezoelectric element 260. As will be appreciated, the quantity of fluid pumped by the pump 200 is dependent upon the operational frequency and voltage of the piezoelectric element 260. Hence, to obtain the higher pressures and flows required for application in aircraft hydraulic systems, the piezo stack must be driven at ever greater voltages and frequencies (for example, 1000V at 1500 Hz). Since the piezo stack 260 is a largely capacitive load (as shown in FIGS. 2 and 3) having a low power factor, high voltages and frequencies create very high peak currents and considerable reactive power in the stack. Furthermore, due to coupling between the hydraulic domain and the electrical domain, the power factor changes with pump load conditions. This can have implications on the sizing of the electrical components, as explained below, which can counteract some of the benefits of using a piezo pump.

An example of the pump drive system 300 is shown in FIG. 2. The drive system 300 includes a power electronic driver 310 (shown by the dotted line) coupled to a high-voltage direct-current, HVDC, supply 320 (e.g., an aircraft HVDC bus). The power electronic driver 310 is formed of a power circuit 330, semiconductor gate drives 340, and a microcontroller 350 for PWM generation. The power circuit incorporates active and passive semiconductor components making up a voltage boost stage 360 and an inverter stage 370. The boost stage 360 increases the supply voltage of the HVDC supply 320, which is then delivered to an inverter stage 370 that provides the inverted voltage drive required by the piezo pump 200. The AC output of the inverter stage 370 tracks a demand reference signal fed into the microcontroller 350.

An auxiliary (e.g., 12V) supply 380 may also be provided to power the gate drivers, microcontroller, and any cooling fans. Alternatively, power for these components can be derived from the aircraft HVDC bus 320.

An example of the power circuit 330 is shown in more detail in FIG. 3. The boost stage 360 may comprise an asynchronous boost converter 362 formed of an inductor, L1, a switch, S1, a Schottky diode, D1, and a capacitor, C1, and arranged to receive an input voltage from the HVDC supply 320 (e.g., an aircraft HDVC bus) and provide an increased voltage output to an HV link point 332. The inverter stage 370 may comprise a pulse width modulation, PWM, controlled half-bridge 372, having switches, S2 and S3, arranged to produce output voltage and frequency. A demand reference signal may provide the waveform and amplitude, which the half-bridge 372 tracks.

The power circuit 330 may also include a number of LC power filters, as shown. An input filter 334 comprising an inductor, $L_{in}$, and a capacitor, $C_{in}$, may be connected between the HVDC supply 320 and the boost converter 362 to ensure appropriate input power quality. The input filter 334 may have a cut-off frequency of approximately 2 kHz. A link filter 336 comprising an inductor, $L_{link}$, and a capacitor, $C_{link}$, may be connected between the boost converter 362 and the half-bridge 372. The link filter 336 may be included to supply reactive power for the piezo stack 260 and to prevent power reversal, which could lead to under-loading of the boost stage 360 and overvoltage at the link 332 causing semiconductor failure and/or overvoltage on the piezo stack 260. The link filter 336 can be sized based on the reactive power requirements of the piezo stack 260. An output filter 338 comprising an inductor, $L_{filter}$, and a resistor, $R_{filter}$, may be connected between the half-bridge 372 and the piezo pump 200 for attenuating switching harmonics. The values of $L_{Filter}$ and $R_{filter}$ can be tuned with the piezo stack 260 capacitance, $C_{load}$, to have an appropriate cut off frequency (e.g., approximately 5 kHz). An additional resistive load, $R_{dump}$, (e.g., 5 kΩ) may be included at the boost stage 360 output to provide damping. This 'dump' resistor can ensure stability of the boost stage 360 when operating with significant reactive load further stabilises the HV link 332.

As already discussed, the oscillating drive voltage necessary to actuate the pump 200 produces a non-continuous electrical power demand. Additionally, owing to the coupling of the hydraulic and electrical systems at the piezo stack 260, any changes in the downstream and pump hydraulic load results in subsequent changes to the electrical characteristics of the piezo stack 260. Therefore, the electrical components mentioned above must be sized for the peak voltage and current over the range of operating conditions. Increasing drive frequency increases the mass of electrical components yet further. Therefore, in a single-pump system such as that illustrated in FIGS. 1-3, the electrical components must be sized for the peak voltage and current, and significant filtering is required to compensate for the reactive load of the piezo stack.

Figure 4:
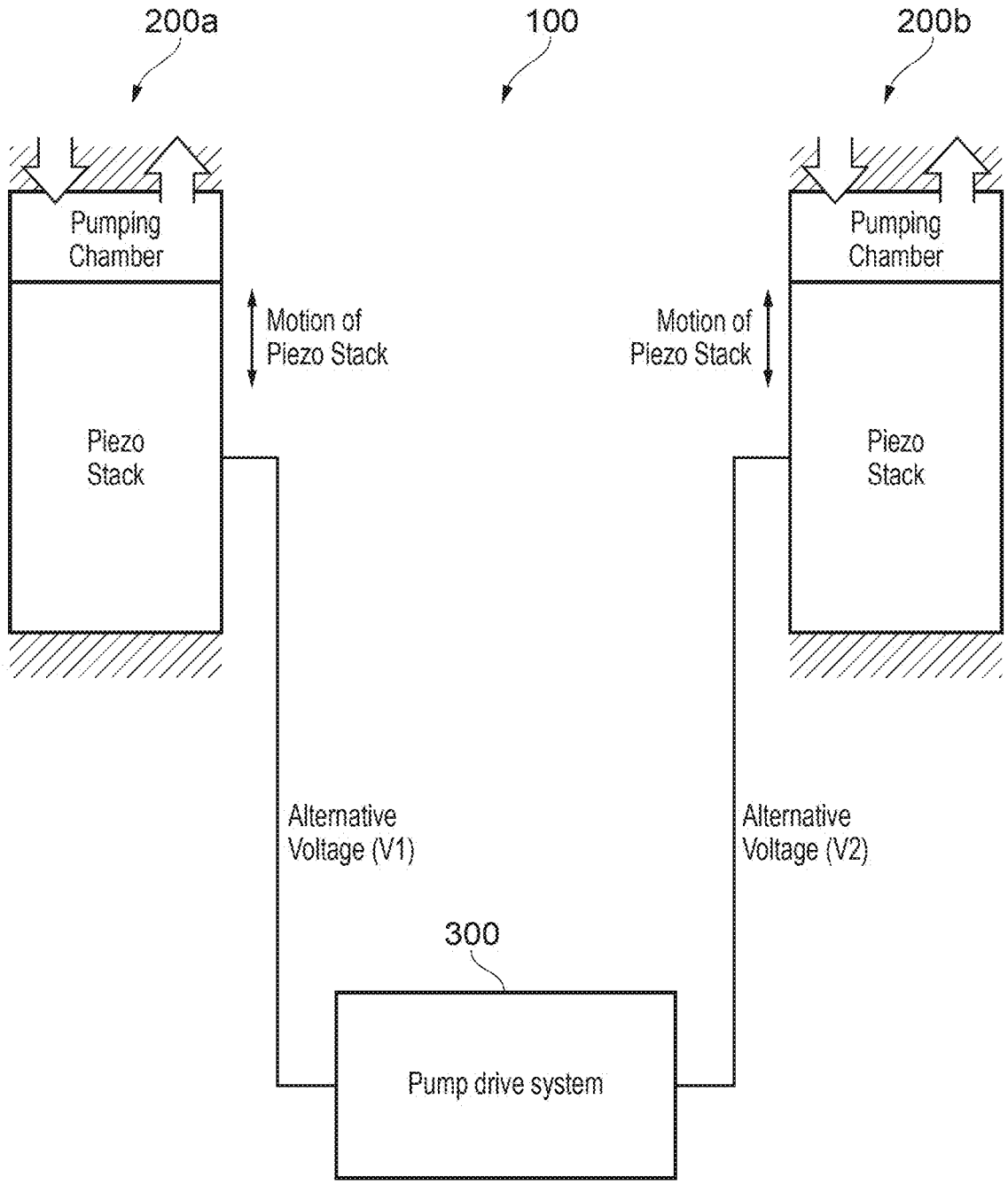
FIG. 4 is a diagram of a pump system including two interleaved piezo-actuated pumps.

The present invention relates to an improved hydraulic pump system, in which two or more piezo pumps are operated out of phase (i.e., interleaved). An example of a dual-pump system 100 example is shown in FIG. 4, in which first and second piezo pumps 200*a* and 200*b* are both driven by a modified version of the pump drive system 300 discussed above, which is configured to provide two oscillating drive voltages, V1 and V2, each driving a respective piezo pump in anti-phase (i.e., 180 degrees out of phase), as shown. The first and second piezo pumps 200*a* and 200*b* are preferably identical and may be the same as the piezo pump 200 discussed above in relation to FIG. 1.

The two or more pumps 200*a-b* can be used to drive the same hydraulic load (e.g., provide hydraulic power for the same actuator) or independent loads (e.g., two separate actuators). In the case where the pumps are used to power the same hydraulic load, running multiple pumps out of phase can result in more continuous flow and therefore reduce the losses (associated with accelerating the fluid) within the downstream system. For a dual-pump system, the hydraulic performance increases with increased phase separation with a maximum improvement at 180 degrees (i.e., anti-phase). The effect is analogous to increasing the number of pistons in a piston pump, or gear teeth in a gear pump to smooth hydraulic ripple (i.e., pulsations in the output hydraulic pressure). This creates a more consistent pressure for the piezo stack 260 to overcome and, due to the coupling between electrical and mechanical domains, a more consistent hydraulic load results in a more consistent and balanced electrical load. Having more than one pump also provides a degree a fault tolerance, since the one or more pumps can remain operational if any of the other pumps fail.

Figure 5:
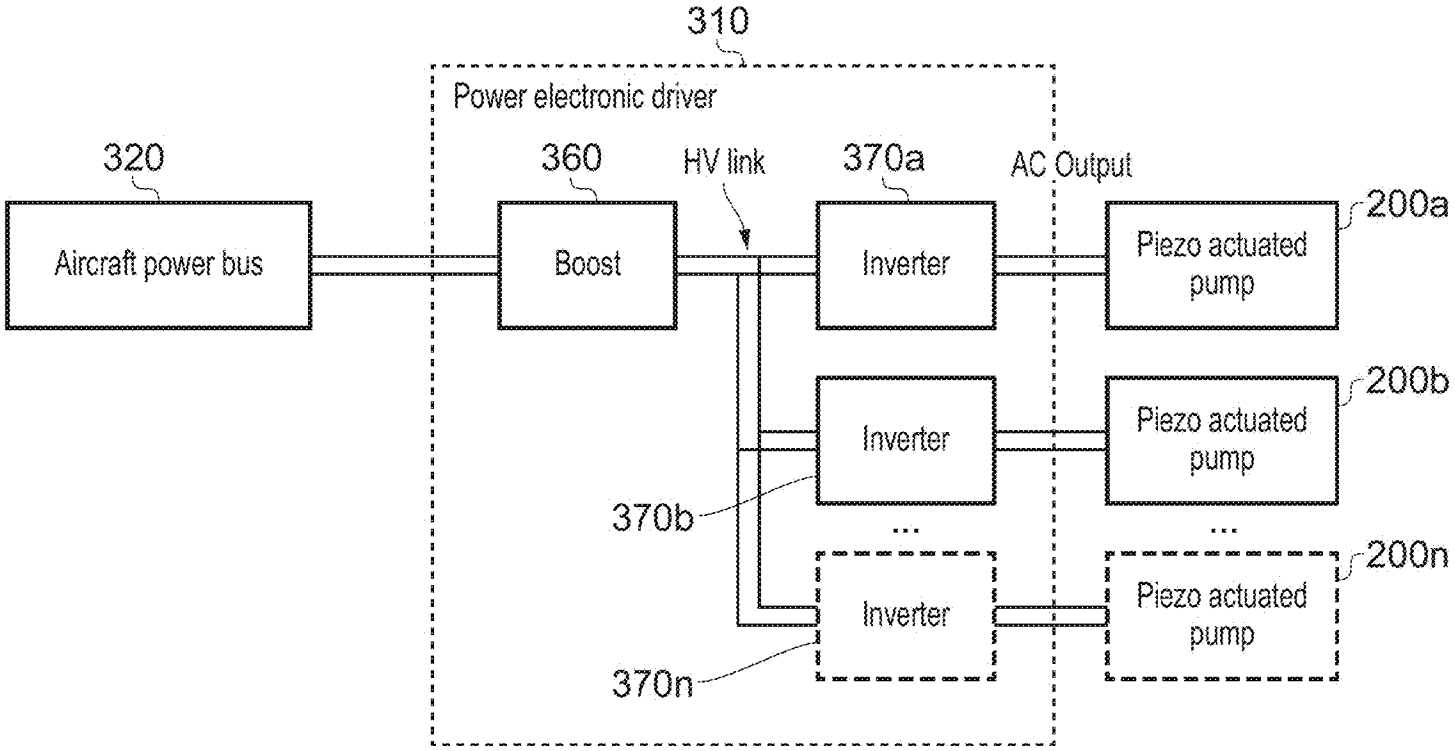
FIG. 5 is a diagram of a pump drive system in accordance with the invention.

An example of the modified pump drive system 300 is shown in FIG. 5. The pump drive system 300 is identical to that of the single-pump system 300, except that the power circuit comprises a plurality of paralleled inverter stages 370*a-n*, each driving a respective piezo pump 200*a-n*. As shown in FIG. 5, a single boost stage 360 increases the supply voltage 320 (from e.g., an aircraft high voltage DC supply), which is then shared by two or more inverter stages 370*a-n* paralleled at the HV link point. Each inverter stage 370*a-n* is coupled to a respective piezo pump 200*a-n* and provides the required inverted voltage drive. In this way, a single boost converter 362 delivers real power to a number of paralleled inverter stages 370*a-n*, which each supply the full reactive power for a piezo pump 200*a-n*. Although not shown, the power electronic driver 310 may also include (and be coupled to) the same components as shown in FIG. 2. For example, the power electronic driver 310 may include the gate drives 340 and the microcontroller 350, as described in relation to FIG. 2. The power electronic driver 310 may be coupled to an auxiliary supply 380 and fans 390, as described in relation to FIG. 2.

Figure 6:
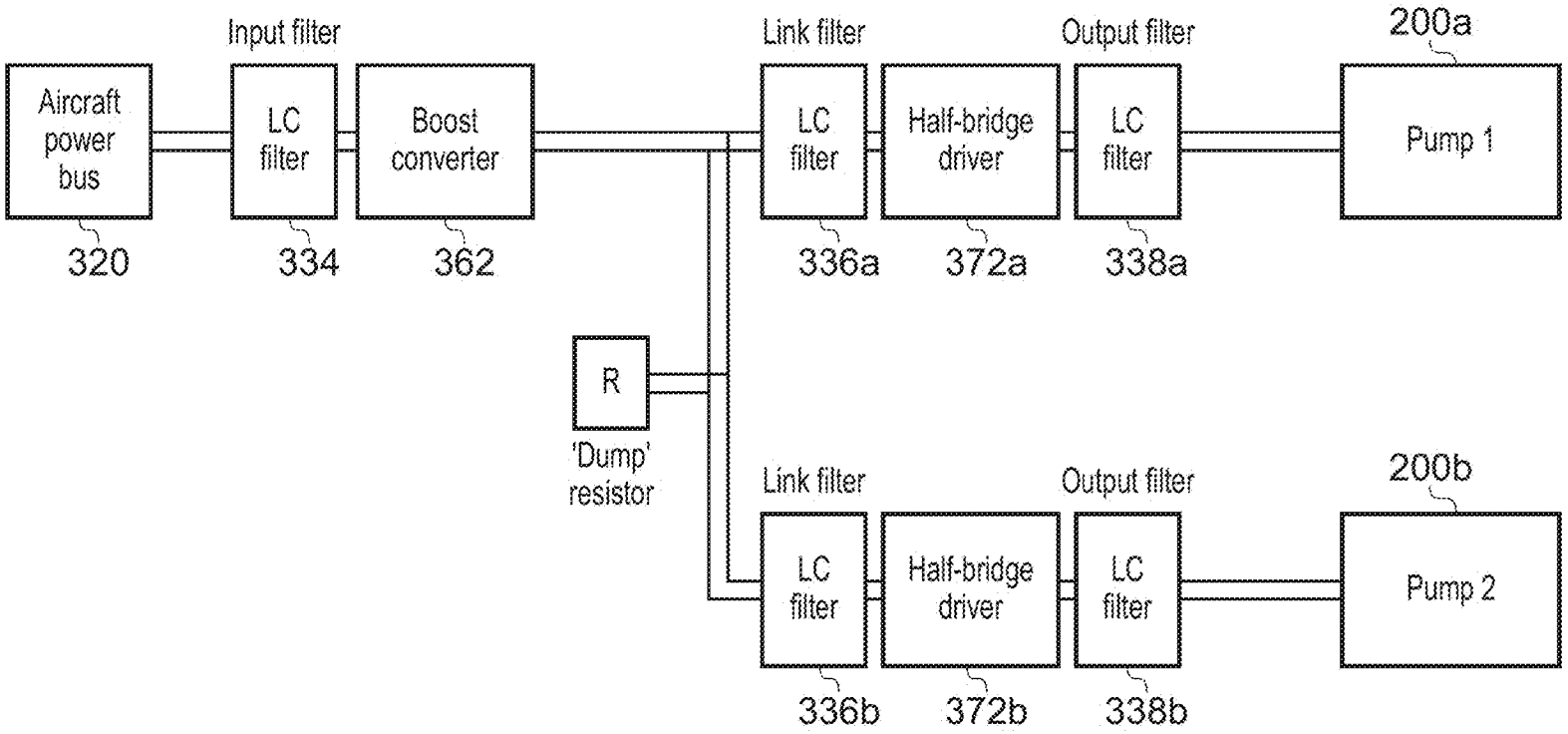
FIG. 6 is a diagram of a pump drive system in accordance with the invention.
Figure 7:
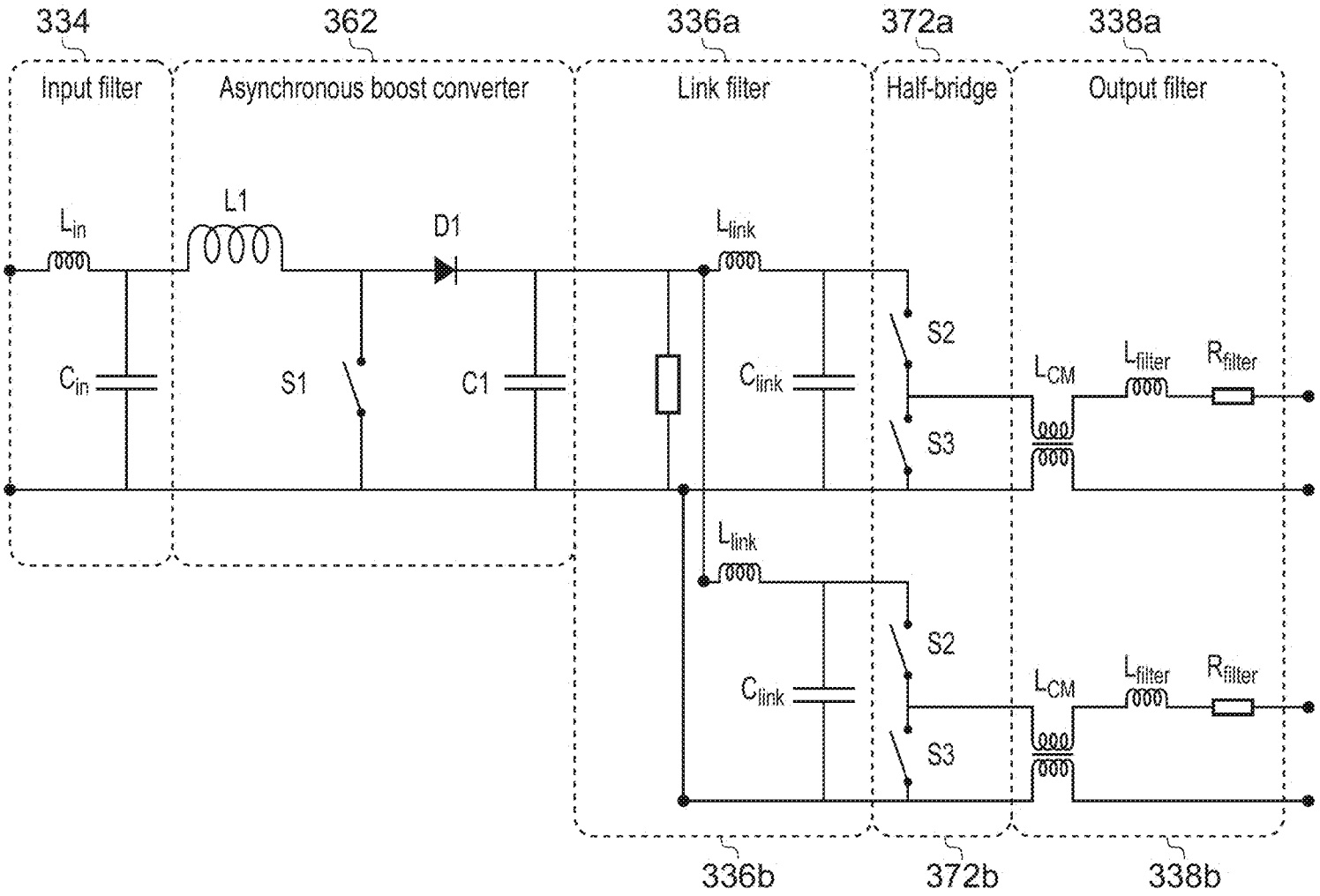
FIG. 7 is a diagram of a power circuit in accordance with the invention.

The boost stage 360 may be the same as the boost stage 360 described in relation to FIG. 3. For example, as shown in FIG. 6, the boost stage 360 may comprise a boost converter 362 having an LC filter 334 on the input side. The boost converter 362 may be configured to give an output voltage up to 1 kV. Each inverter stage 370*a-n* may also be the same as the inverter stage 370 described above for the one-pump system. For example, each inverter stage 370*a-n* may comprise a PWM-controlled half-bridge 372*a-n* that generates the required AC waveform according to a demand reference. Hence, the boost converter 362 delivers high voltage DC and the half-bridges 372*a-n* switch the high voltage to synthesise the required output waveform. The skilled person will also appreciate other ways in which the inverter stage 370 can be implemented, such as using a full bridge inverter. Each inverter stage 370*a-n* may also comprise a link LC filter 336*a-n* on the input side of the half-bridge 372*a-n* and an output LC filter 338*a-n* on the output side of the half-bridge 372*a-n*. An example of the full power circuit 330 for a dual pump driver is shown in FIG. 7. As will be appreciated, the power circuit 330 can be implemented in place of the power circuit 330 in FIG. 2.

Due to the nature of the electrical topology and the efficiency benefits it brings, the current passing through the boost stage 360 when running multiple (e.g., two or three) pumps 200*a-n* out of phase at a given drive voltage is less than the current if only one pump was running. With this architecture, and by running each pump out of phase (the phase difference being dependent on the number in the system, as discussed below), the charge returned to the HV link point when one piezo stack is contracting can be used to partially drive the second pump stack as it expands. In other words, when multiple pumps are operated, correct phase alignment allows their reactive component to be utilised to produce a more continual load power. This results in a reduced peak power demand at the coupled (link) point, allowing the link filter to be reduced in size. Similarly, the input filter and boost converter can be rated for mean power, rather than peak power, enabling full utilisation of boost converter rating (maximise power density). Together, these changes reduce the overall mass and volume of the electronics, increase the power density of the driver and reduce the necessity for the stabilising resistive load (increasing drive efficiency). These improvements in the electrical domain are realised even where the piezo pumps are used to drive separate loads.

For a two-pump system, the link power ripple reduces with increased phase separation with a maximum improvement (i.e., lowest link power ripple) at a phase separation of 180 degrees (i.e., antiphase). Where the piezo pumps are used to drive the same load, hydraulic performance and mean electrical power also increase towards antiphase. The same or further improvements can be realised with a greater number of interleaved pumps. In particular, since electrical power in the stack may be non-sinusoidal and not symmetrical, a further benefit may be achieved with a three-pump system as this can cancel the fundamental frequency and 2nd harmonic frequency, allowing further reduction in power filter size. As will be appreciated, the phasing of each inverter stage can be evenly distributed across the 360-degree phase range depending on the number of paralleled stages, so that if there are N inverters (driving N pumps), the phase separation can be 360/N. For example, in a three-pump system, each pump can be driven 120 degrees out of phase.

The two power electronic converter stages 360, 370 (i.e., the boost converter 362 and the half-bridges 372*a-n*) may be decoupled at the HV link, allowing each stage to be designed and controlled independently. Both power converters can be based on SiC MOSFETs. High frequency, high efficiency, switching allows the size of passive components in the power circuit to be reduced and so their designs benefit from the high transition rates of these semiconductors.

In the discussion so far, it has been assumed that the piezo pumps 200*a-n* and their operating environments are substantially identical. However, in practice this is difficult to achieve. The electrical characteristics of the piezo are dependent on the mechanical load, material variation and environment. The material variation and geometric tolerances of the piezo stack are commonly quite high (e.g., around 10%). Additionally, where there is mechanical pre-load this varies with the geometric tolerances coupled with machined component tolerances and any variation in spring rates. The mechanical load can further vary from pump to pump due to valve differences and different pressure losses, for example. Finally, temperature and hysteresis can have a large influence on the electrical characteristic. Overall, there are many parameters to which the electrical load is sensitive. Therefore, whilst operating multiple pumps out of phase can help to make hydraulic and electrical power demand much more consistent, the many sensitivities and highly coupled domains can result in an imbalance and instability within the electrical drive, which would require further filtering and so reduce the savings. For example, the assembly of two pumps with the same nominal design could create a large imbalance (a variation in power in the stack of 20% has been observed at the same ambient conditions). Hence, within such a system a link filter would still be required to cope with imbalances in power demand and return from each pump, which could otherwise cause an overvoltage (and de-polarisation) of the piezo stack.

The inventors have found that electrically balancing the piezo pumps with an active balancing control system enables the advantages of the invention to be fully realised. The active balancing control system is configured to determine the power consumption of the piezo pumps and to regulate their power consumption by controlling the voltage of the inverter stages. The power consumption can be determined by measuring the voltage and current of each piezo stack (via, e.g., voltage and current monitoring circuitry, including voltage and current sensors) whilst the pumps are being driven. Each pump's power consumption can then be regulated and balanced with the other pumps by controlling the driving voltage of the inverter stage (e.g., each half-bridge driver). For example, in a dual-pump system in which one pump has a higher power consumption, the driving voltage of the half-bridge for that pump can be reduced until the power consumption matches that of the other pump.

The active balancing control system can be implemented with a closed loop controller used to regulate the power to each stack by varying the demand voltage. This can be implemented in the microcontroller 350 shown in FIG. 2, a secondary microcontroller, or in a dedicated controller for each inverter stage 370*a-n*.

Successful balancing of the pumps can enable an optimal power electric design to be realised. As mentioned above, sharing power electronics can have system benefits such as reduced cost, overall mass and volume (due to packaging), and potentially improved reliability (if components can be shared). However, the shared components within the power electronics are limited when driving different loads in open loop. Active balancing provides a way of practically sharing power electronics for two (or more) different pumps by matching the loads where possible to reduce the peak demands and so reduce the size of components within the power electronics.

The active balancing system can also provide fault tolerance. As mentioned above, the current passing through the boost stage 360 when running multiple pumps 200*a-n* out of phase at a given drive voltage is less than the current if only one pump was running. Therefore, if one pump were to fail and the voltage demand was not changed, the boost stage 360 would not be sufficiently sized (or would otherwise have to be oversized during normal operation) to deal with the change. However, with the active balancing control system, the failure can be detected and then compensated for, so that one pump could continue to provide hydraulic fluid (albeit at a lower power rating). The failure can be detected using the voltage and current monitoring circuitry to highlight mismatches between output drivers, as well as highlighting other issues, such as low voltage or high currents, that might indicate a problem.

The active balancing system can also be used to automatically adjust the phasing of each driver depending on the number of 'active' (i.e., operational) pumps, so that the phase can be evenly distributed across the 360-degree phase range. For example, if there are N drivers, the phase gap can be automatically determined and set to 360/N. This can be adaptive in the sense that the system can respond to changes in the number of active pumps: if one or more pumps were to fail, the phase difference between each remaining pump could be re-adjusted to have less of an impact in the total pump output. For example, if one pump failed in a three-pump system (each of which was originally running 120 degrees out of phase), then the active balancing system could control the power electronics to adjust the phase of the two remaining operable pumps to a 180-degree phase difference. This means that the electronics do not have to be rated to the peak current and voltage if one pump were to fail, as above, but also that a higher hydraulic output is achievable with the two remaining pumps than would be possible without active balancing.

As discussed above, for perfectly balanced pumps the optimal phase separation would be to operate them completely out of phase (i.e., drive them 180 degrees apart if driving two pumps). However, as the pump drive system allows the pumps to be driven at higher frequencies, the operating point can approach the bandwidth of commonly used one-way valves within the pump. These too are sensitive to manufacturing and assembly tolerances, and operating variation. Therefore, the valve opening and closing can be slightly out of phase with the piezo drive. This also has an impact on the electrical load.

To fully capitalise on both the hydraulic benefits, and because the electrical load is affected by the operation of the valves, the phase difference of the pump drives can first be adjusted prior to regulating the power available to each stack. Pressure sensors, such as chamber pressure transducers, can be used to detect peak pressures in the pumping cycle and adjust the driving phase difference so that the pumping phase is, e.g., for a dual-pump system, 180 degrees out of phase. The adjustment from the initial 180 degrees phase difference can be incremented (as the electrical load will also change and so will have further dynamic effects). The maximum adjustment from 180 degrees can be 45 degrees.

It is discussed up to this point that a closed loop controller will be used to regulate the power to each stack by varying the demand voltage. For both efficiency and because in reality, the continuous run time of a piezo pump is likely to be limited to short periods of time, it would be beneficial to reach the optimal running point quickly. For this reason, an 'expert system' could be generated for the controller that uses the different operating conditions as its inputs. It could also be used to recognise certain pumps (such as calibration information) that would already accommodate for pump-to-pump manufacturing and assembly variation. This would offer a preferred starting balance for a multi pump driver, which would then also be adjusted for environmental and operating conditions. For instance, it is known that temperature will have an impact on the electrical characteristic of the piezo stack (increased capacitance). Therefore, the controller could be trained to identify both differences in the pumps and start from an adjusted drive balance before also adjusting both pumps' drives to allow for a modified power rating that results in a longer available run time.

The invention claimed is:

1. A drive circuit for a plurality of piezo-actuated hydraulic pumps for an aircraft, the drive circuit comprising:

a voltage boost stage configured to receive a DC input supply voltage and deliver an increased DC output voltage to a high voltage, HV, link point;

a plurality of inverter stages coupled in parallel at the HV link point, wherein each inverter stage is arranged to receive the increased DC voltage from the HV link point and generate an oscillating output voltage for driving a respective piezo-actuated pump; and a control system configured to control the output voltage and phase of the inverter stages to drive the plurality of piezo-actuated pumps out of phase, wherein the control system is further configured to measure the power consumption of each piezo-actuated pump and to regulate the output voltage of at least one of the inverter stages to balance the power consumption of each piezo-actuated pump.

2. The drive circuit of claim 1, wherein each inverter stage comprises a pulse width modulation, PWM, controlled half-bridge inverter and wherein the control system is a switch control system for PWM generation.

3. The drive circuit of claim 2, wherein each inverter stage further comprises at least one of:

a link filter comprising an LC filter connected between a respective half-bridge inverter and the HV link point; and an output filter comprising an LC filter connected between the respective half-bridge inverter and a respective piezo pump.

4. The drive circuit of claim 1, wherein the boost stage comprises an asynchronous boost converter.

5. The drive circuit of claim 4, further comprising an input filter comprising an LC filter coupled at an input of the asynchronous boost converter.

6. The drive circuit of claim 1, wherein the control system is configured to control the phase of the inverter stages to separate the plurality of piezo-actuated pumps in phase according to the relationship 360°/N, where N is the number of pumps.

7. The drive circuit of claim 1, comprising:

two paralleled inverter stages for driving two piezo-actuated hydraulic pumps 180 degrees out of phase; or three paralleled inverter stages for driving three piezo-actuated hydraulic pumps 120 degrees out of phase.

8. The drive circuit of claim 1, wherein the control system is further configured to detect a failure of one or more piezo-actuated pumps of the plurality of piezo-actuated pumps.

9. The drive circuit of claim 8, wherein the control system is further configured to automatically adjust the phase and/or voltage output of one or more the inverter stages in response to detecting a failure of one or more piezo-actuated pumps.

10. A hydraulic pump system for an aircraft, the hydraulic pump system comprising:

the drive circuit of claim 1; and the plurality of piezo-actuated hydraulic pumps.

11. An actuator system for an aircraft, the actuator system comprising:

the hydraulic pump system of claim 10; and a hydraulic actuator, wherein the actuator is arranged to receive hydraulic power from the plurality of piezo-actuated hydraulic pumps.

* * * * *